US007563365B2

(12) United States Patent
Pellington et al.

(10) Patent No.: US 7,563,365 B2
(45) **Date of Patent: *Jul. 21, 2009**

(54) ADJUSTABLE SKIMMER SAFETY SYSTEM

(76) Inventors: George S. Pellington, 727-A Timber Ridge Trail SW., Vero Beach, FL (US) 32962; Paul E. Pennington, 336 W. College Ave., Santa Rosa, CA (US) 95401; Shane Stevens, 2734 Land-O-Lakes Blvd., Land-O-Lakes, FL (US) 34639

( * ) Notice: Subject to any disclaimer, the term of this patent is extended or adjusted under 35 U.S.C. 154(b) by 162 days.

This patent is subject to a terminal disclaimer.

(21) Appl. No.: 11/787,432

(22) Filed: Apr. 16, 2007

(65) Prior Publication Data

US 2008/0099387 A1 May 1, 2008

Related U.S. Application Data

(63) Continuation-in-part of application No. 11/701,249, filed on Feb. 1, 2007, which is a continuation-in-part of application No. 11/588,909, filed on Oct. 27, 2006.

(51) Int. Cl.
*E04H 4/12* (2006.01)

(52) U.S. Cl. ..... 210/167.1; 210/167.12; 4/507

(58) Field of Classification Search ..... 210/167.1, 210/167.19, 416.1, 416.2, 448, 167.12; 4/507
See application file for complete search history.

(56) References Cited

U.S. PATENT DOCUMENTS 2,400,070 A * 5/1946 Boosey ..... 210/165
2,550,402 A * 4/1951 Boosey ..... 210/165
2,731,154 A * 1/1956 Burnell ..... 210/130
2,961,098 A * 11/1960 Nash ..... 210/241
2,980,256 A * 4/1961 Nash ..... 210/167.13
3,297,163 A * 1/1967 Landon ..... 210/331
3,306,448 A 2/1967 Baker
3,567,020 A 3/1971 Whitaker
3,616,916 A 11/1971 Greene
3,628,664 A * 12/1971 Stanwood ..... 210/167.1
3,701,427 A 10/1972 Howard
3,780,871 A * 12/1973 Hicks et al. ..... 210/471
3,899,425 A * 8/1975 Lewis ..... 210/206
4,115,878 A 9/1978 Johnson et al.
4,154,679 A * 5/1979 Farage ..... 210/121
4,297,209 A * 10/1981 DeVisser et al. ..... 210/107
4,516,606 A 5/1985 Worley (Continued)

*Primary Examiner*—Fred Prince
(74) *Attorney, Agent, or Firm*—Christopher & Weisberg, P.A.

(57) ABSTRACT

The present invention provides a swimming pool safety system including a housing having a first opening for coupling to a pump, a second opening for coupling to a pool drain, and a third opening for receiving water form a surface of a pool. The present invention may include a skimmer basket positionable in the housing, where the skimmer basket defines a debris-retaining region and a member having a passage therethrough. A method of use of the present invention is also provided in which the housing may be configured to reduce an entrapment force experienced at a pool drain, and to further provide a fluid flow path through the debris-retaining region of the skimmer basket to place the first opening of the housing in fluid communication with the surrounding atmosphere. A collector vessel may also be included, the collector vessel having an adjustable extension element to modify a resulting entrapment force.

16 Claims, 10 Drawing Sheets

U.S. PATENT DOCUMENTS 4,615,056 A * 10/1986 Grant ..... 4/366
5,118,418 A * 6/1992 Roussel ..... 210/278
5,132,013 A * 7/1992 Thompson ..... 210/448
5,830,350 A 11/1998 Voss et al.
6,895,608 B2 5/2005 Goettl
7,055,189 B2 6/2006 Goettl
7,089,606 B2 8/2006 Goettl
2001/0030150 A1 * 10/2001 Remon ..... 210/163

* cited by examiner

ADJUSTABLE SKIMMER SAFETY SYSTEM

CROSS-REFERENCE TO RELATED APPLICATION

This application is a continuation-in-part-of pending application Ser. No. 11/701,249, filed Feb. 1, 2007, entitled POOL SAFETY SYSTEM, which application is a continuation-in-part of pending Utility patent application Ser. No. 11/588,909, filed Oct. 27, 2006, entitled POOL SKIMMER SAFETY SYSTEM, the entirety of all of which is incorporated herein by reference.

STATEMENT REGARDING FEDERALLY SPONSORED RESEARCH OR DEVELOPMENT n/a

FIELD OF THE INVENTION

The present invention relates to a method and system for limiting and/or reducing an entrapment force in pool drains in order to avoid injury.

BACKGROUND OF THE INVENTION

In general, swimming pools include a pump for drawing water from a drain at the bottom of a pool through a skimmer housing and towards a filter from which the water is returned to the pool. The skimmer housing is often installed at least partially in the ground or beneath a deck surface, having a removable lid and a basket contained therein that retains leaves or other debris from the pool and prevents clogging of the pump and/or filter.

In order to provide sufficient circulation of pool water such that the filter and other components of the pool operate as desired, the pool pump providing the circulation often has a fairly large flow rate. As water is drawn through the drain by the pump, a suction force is created at the surface of the drain, and as such, the drain at the bottom of a swimming pool can pose a significant safety hazard to those occupying of the pool, in particular to a young child or a person of limited physical strength. In the event someone in the pool inadvertently covers the drain with a part of his/her body, the suction force will tend to retain the user against the drain unless the user has sufficient strength to push away from the drain. In fact, in most cases, the suction force is so substantial, i.e., in the range of 500 pounds of force or more, that even an adult of above-average strength will be unable to overcome the suction force being experienced. As a result, there is a strong likelihood that a person will panic, increasing the chance that drowning may result. Even under circumstances where an individual is capable of pushing away from the drain, the possibility of incurring serious injury remains nonetheless.

To overcome the potential for injury or drowning due to the suction force and thus the chance of being drawn against and retained by a swimming pool drain, numerous devices have been developed over the years to reduce and/or eliminate the suction force created during a blockage or entrapment. Some of these devices introduce air to the inlet side of the pump in response to the sensed high suction condition, which results in loss of pump prime. Other devices may interrupt the power source to the pump, thereby causing the pump to cease operation. There are also devices which provide for a conduit to open to the atmosphere upon sensing a predetermined level of suction, which allows air to enter the system and thereby break the vacuum or suction force at the drain.

While certain devices have been proposed, there are numerous problems present with existing devices. For example, many of the devices are very expensive and have multiple moving parts, which increases the likelihood that the device may malfunction or fail to operate as intended. In addition, some of the devices provide false signals triggered by filled drain sumps and/or skimmer baskets, or due to pressure variations created when the pump is first turned on. Moreover, installation of some devices may require excavation or other drastic measures for installation, which greatly increases cost and provides a deterrent to use and integration. Finally, upon installing a particular device, the pump might be damaged or otherwise negatively impacted upon actuation of the device, resulting in the attendant problems of expense and loss of use of the swimming pool.

In view of the above-described problems and limitations, it would be desirable to provide a safety system for reducing and/or eliminating suction forces experienced during entrapment against a pool drain that is simple in operation, cost effective, and easily integrated with existing pools.

SUMMARY OF THE INVENTION

The present invention advantageously provides a method and system for reducing and/or eliminating suction forces experienced during entrapment against a pool drain that is simple in operation, cost effective, and easily integrated with existing pools. In particular, the pool safety system of the present invention may include a housing, where the housing defines a housing base, a housing sidewall extending upward from the housing base, a first opening in one of the housing base and housing sidewall for coupling to a pump, a second opening in one of the housing base and housing sidewall for coupling to a pool drain, and a third opening in one of the housing base and housing sidewall for receiving water from the surface of a swimming pool.

Moreover, the housing may be configured to limit an experienced entrapment force by constructing the housing with a predetermined dimension resulting in a predetermined water volume and/or surface area. For example, by selecting and constructing the housing with predetermined dimensions, the entrapment force experienced upon blocking the swimming pool drain and thus water flow through the second opening of the housing, the entrapping force may be limited to a range of approximately 10-25 pounds of force.

The system of the present invention may further include a container, such as a skimmer basket, where the container defines a basket bottom wall having an opening therethrough, a basket sidewall extending from the basket bottom wall, and a rim along an upper edge of the container. The container may further include a container opening and a member extending from the container opening to a point above the rim of the container. The elongate member may define a member opening and a passage therethrough for placing the container opening and the member opening in fluid communication. The container may include a debris-retaining region within the base and sidewalls for containing leaves or other items in pool, while the member may be positioned within the debris-retaining region such that the first opening is in fluid communication with the opening in the basket bottom wall. During operation, the pool system may provide a fluid flow path from the first opening of the housing to the surrounding atmosphere such that the fluid flow path is separated from the debris-retaining region of the skimmer basket. As such, the system ensures that air is able to enter the second opening of the housing in the event of an entrapment.

The present invention may further include a collector vessel or container coupled to a swimming pool configured to reduce the entrapment force experienced at a drain on a submerged surface of a swimming pool in addition to and/or alternatively to the skimmer housing 10 described above. The collector vessel may include a first opening in fluid communication with a drain, a second opening in fluid communication with a pump, and a third opening to allow excess fluid to overflow out of the vessel. The collector vessel may include an extension element in fluid communication with/or otherwise coupled to the first opening. The extension element may be movably positionable about the first opening to adjust the effective column of water height above the first opening and to further ensure that the entrapment force at the drain is minimized to a desirable degree. In particular, the extension element may include a body having a first extension opening, a second extension opening, and a passage therebetween. The first extension opening may be coupled to the first opening of the vessel. The extension element may then be manipulated such that the second extension opening is offset from the first extension opening to provide a height from the water surface level of approximately 5 to 20 inches.

The present invention may further include a skimmer assembly, where the skimmer assembly may generally include a container, a member, a valve, and a base element. The container of the skimmer assembly may define a container bottom wall with an opening therethrough, and one or more container sidewalls extending upward around a periphery of the bottom wall, where the one or more sidewalls define a rim or top edge of the container when oriented in a position for use. The container bottom wall and the container sidewalls define a debris-retaining region, and one or more apertures may be situated about the container bottom wall and/or the one or more container sidewalls for allowing the passage of water therethrough. The member of the skimmer assembly may define a first opening at a first end, a second opening at a second end, and a passage therethrough placing the first and second openings in fluid communication with one another. The member may be movably positionable through the opening in the bottom wall of the container. In addition, at least a portion of the valve may be coupled to the member and/or the container. The valve may include a first component and a second component, where the first and second component may be movable with respect to each other in order to affect a particular fluid flow rate through the valve.

DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
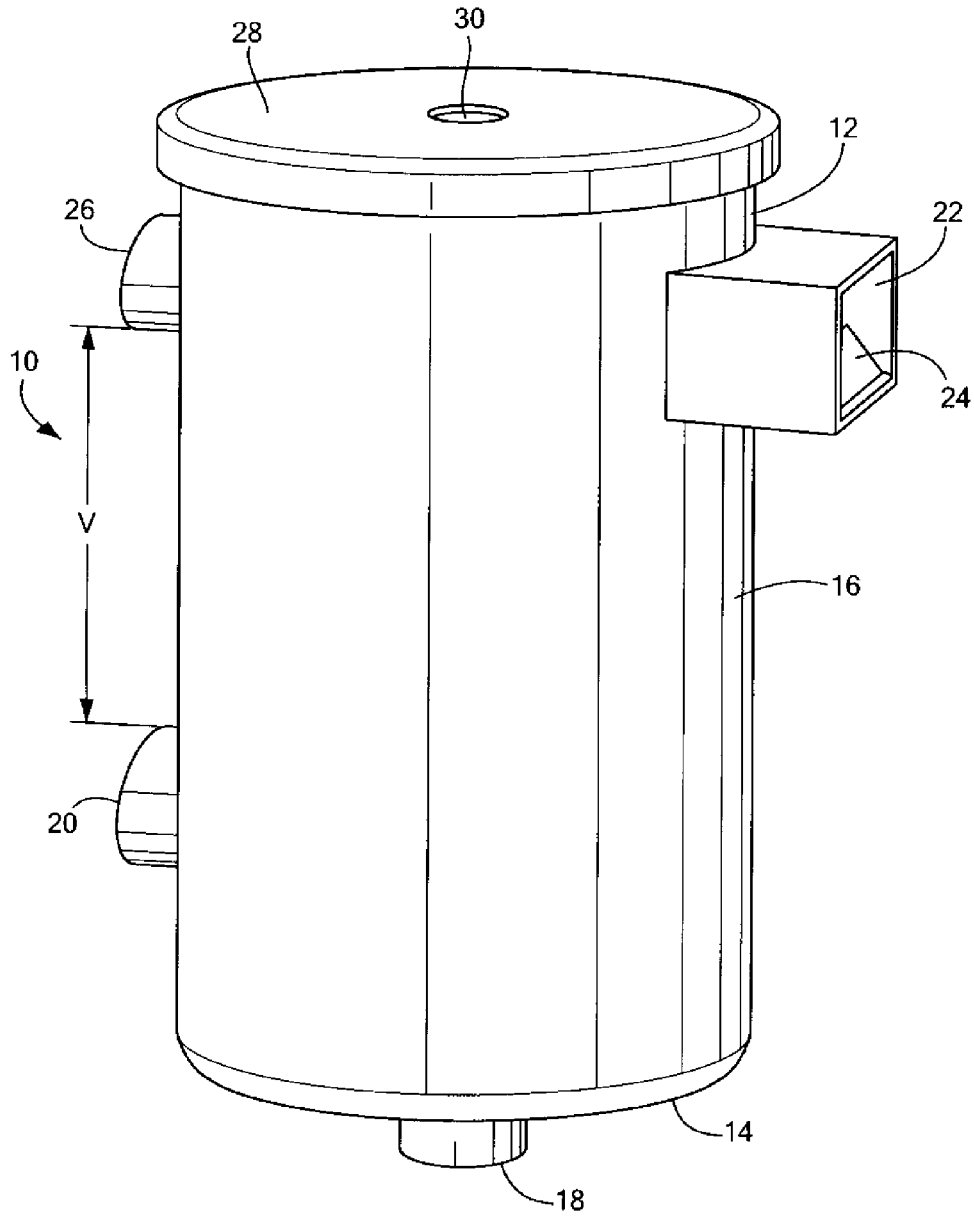
FIG. 1 illustrates an embodiment of a housing in accordance with the present invention.

The present invention provides a safety system and method of use thereof for reducing and/or eliminating suction forces experienced during entrapment against a pool drain that is simple in operation, cost effective, and easily integrated with existing pools. Now referring to FIG. 1, the system may include a housing 10 for use with a swimming pool (not shown) having a pump (not shown). Of note, as used herein, the term "swimming pool" is intended to include traditional in-ground swimming pools, above-ground swimming pools, spas, or any other large, water filled container having a circulation system with fluid flow therethrough. The housing 10 may contain one or more openings in fluid communication with the swimming pool, pump, and the like. For example, the housing 10 may be a skimmer housing 10 commonly found with existing pools installed just below the surface adjacent to a side of the swimming pool. The housing 10 may define a largely hollow interior cavity having a top portion 12, a lower wall 14, and one or more sidewalls 16 extending therebetween.

In particular, the housing 10 may further include a first opening 18 in fluid communication with the pump, as well as a second opening 20 in fluid communication with a drain located along a surface of the swimming pool. Of note, although a single opening 20 in fluid communication with a drain is shown for illustrative purposes, in some applications the housing 10 may contain multiple openings in fluid communication with multiple drains on submerged surfaces of a swimming pool and/or spa. The first and second openings may be located along either the lower and/or sidewalls of the housing 10. In addition, the housing 10 may include a third opening 22 along a sidewall of the housing 10 that is in fluid communication with the pool in proximity to the water surface of the pool, such that, under typical conditions, the surface of the water of the pool is at a height between an upper and lower surface of the third opening 22. An adjustable floating weir 24 may be positioned in the third opening 22 to regulate the passage of fluids and debris therethrough. In addition, the housing 10 may also provide a fourth opening 26 along a sidewall 16 to provide a vent or overflow path for drainage in the event the water level rises beyond a desired or intended height. As such, a lower edge of the fourth opening 26 may be adjacent to the water surface level of the pool. The housing 10 may also include a lid 28 positionable about the top portion 12 of the housing 10, where the lid may further include an opening 30 therethrough.

The housing 10 may be configured to limit an entrapping force experienced at the drain in the pool. In the event the drain becomes obstructed, the resulting entrapping force is directly correlated to the dimensions and resulting water volume of the housing 10. In particular, the entrapping force experienced at the drain coincides with the force experienced at the second opening 20 of the housing 10. The force experienced at the second opening 20 of the housing 10 is impacted by the water volume in the housing 10 and the corresponding hydrostatic differential head of the water volume. The housing 10 may thus be configured and dimensioned such that in the event of an entrapment, the maximum force experienced at the pool drain is limited to enable a person or child to be able to free themselves without additional aid. While the entrapping force could never be completely eliminated as it would prevent a swimming pool pump system from operating, the potential entrapping force could be reduced to a safer level, i.e., in the range of about 10-25 pounds. This reduced range of force may allow even small children to overcome the entrapment force experienced and to swim to safety. By configuring the housing 10 to provide a predetermined hydrostatic differential, a correlating reduction of the entrapment force experienced at the drain may be achieved.

As an example of a particular configuration, the second opening 20 of the housing 10 may be located at a vertical distance from the typical water surface level of the pool. As previously discussed, the water level of the pool may be at least partially dictated by a lower edge of the fourth opening 26, and as such, a vertical distance "V" between the lower edge of the fourth opening 26 and an upper edge of the second opening 20 may define a height of a column of water within the housing 10. It is known that a one foot column of water correlates to 0.433 psi. Thus, the vertical distance "V" is equal to a pressure of "V" multiplied by 0.433 psi. By taking the resulting value and multiplying it by the open surface area of the drain, the resulting entrapment force may be calculated. For example, should the vertical distance "V" equal 11 inches, the resulting pressure would be (11 inches/12 inches-per-foot)×0.433 psi=0.397 psi. Now, in the case where the drain has an open area of approximately 40 square inches, the force is equal to 0.397 psi×40 square inches=15.87 pounds of force. Of course, while specific measurements have been provided, the dimensions of the housing 10 for a particular application may vary in order to achieve a predetermined, limited entrapment force experienced at the drain, and the distance "V" may vary between approximately 6 inches and approximately 20 inches.

Figure 2:
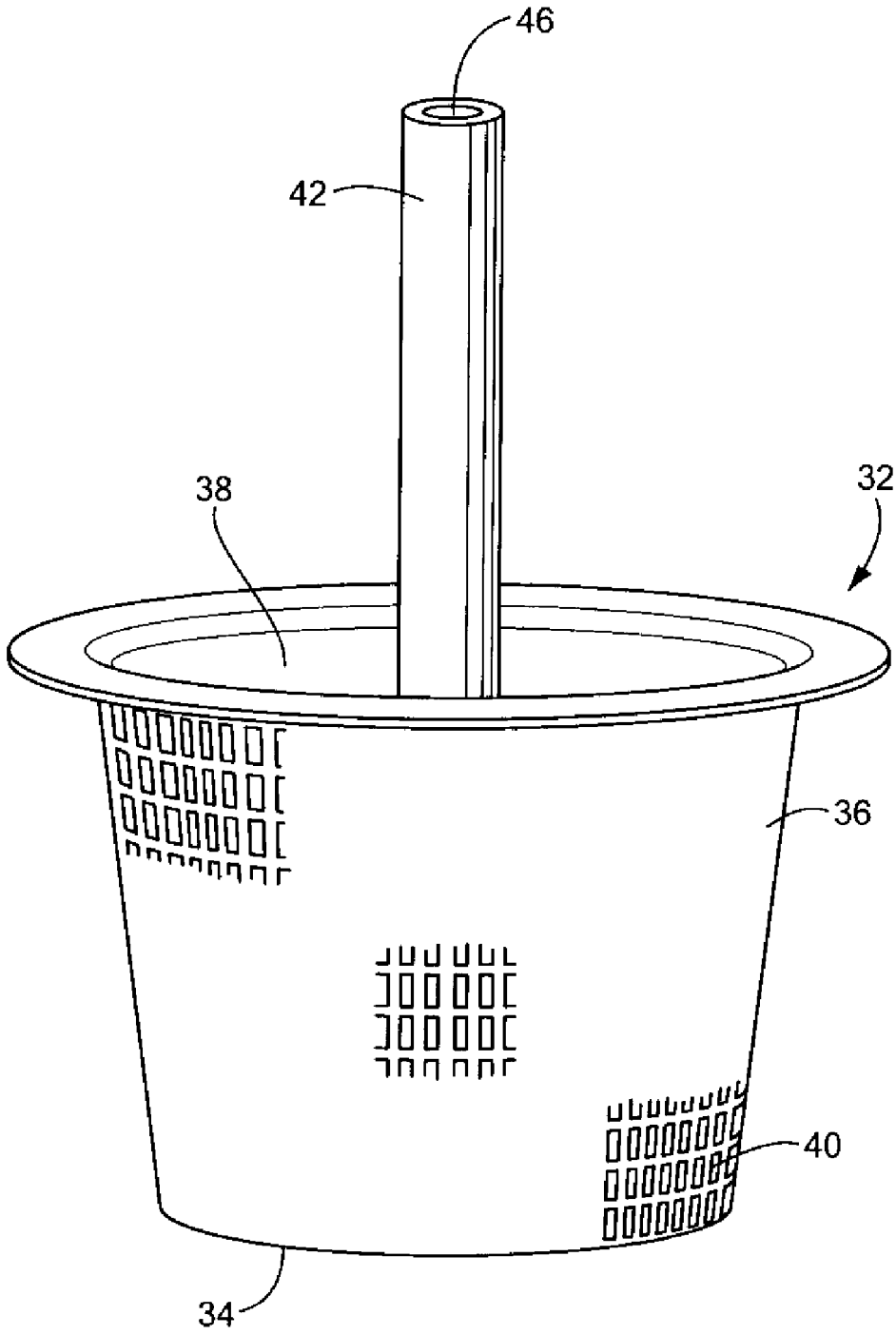
FIG. 2 shows an embodiment of a container in accordance with the present invention.
Figure 3:
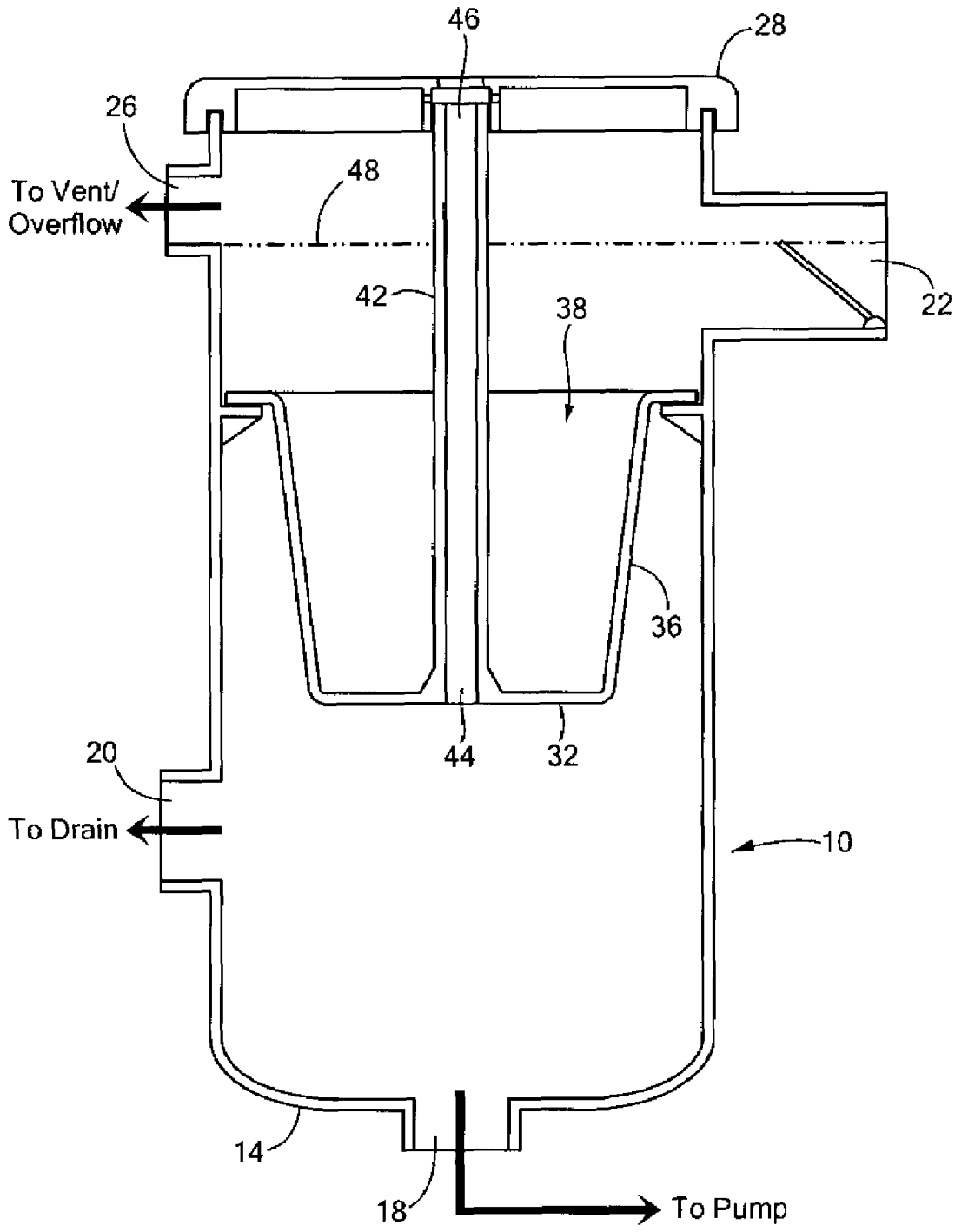
FIG. 3 is a cross-sectional view of an embodiment of a container positioned in a housing in accordance with the present invention.

As shown in FIGS. 2 and 3, the system of the present invention may further include a container 32 positionable within at least a portion of the housing 10. The container 32 may include a skimmer basket or the like, where the container 32 may define a container bottom wall 34 with an opening therethrough, and one or more container sidewalls 36 extending upward around a periphery of the bottom wall, where the one or more sidewalls define a rim or top edge of the container when oriented in a position for use. The container bottom wall 34 and the container sidewalls 36 define a debris-retaining region 38 for collecting items floating in the pool as they are drawn into the container 32 by the circulation of the pool water. One or more apertures 40 may be situated about the container bottom wall 34 and/or the one or more container sidewalls 36 for allowing the passage of water therethrough while retaining larger objects and debris contained within the debris-retaining region 38 for subsequent cleaning or removal. The container may include a myriad of shapes and dimensions which can be varied for a particular use and/or application.

The container 32 may further include a member 42 extending upward from an opening 44 in the container. The member may define a member opening 46 positionable above the rim of the container for providing fluid communication between the container opening 44 and the member opening 46. Accordingly, the member may include a hollow passage extending therethrough to achieve the desired fluid communication. The member 42 may be positioned about one of the bottom wall 34 or sidewall 36 of the container. Further, the member 42 may include a member sidewall extending between the first and second openings, where the member sidewall is substantially void of any openings such that a fluid and/or gas is largely prevented from entering the hollow passage except through the container opening 44 and the member opening 46. It is contemplated that the container 32 may be constructed as an integral component through molding or similar manufacturing methods, or, alternatively, assembled by coupling one or more pieces together. The housing 10 may include a shelf or other coupling feature to aid in the positioning and/or retention of the container within the housing 10.

Referring to FIG. 3, in an exemplary use of the swimming pool safety system of the present invention, the housing 10 is coupled to a swimming pool such that the first opening 18 of the housing 10 is in fluid communication with a pump, the second opening 20 is placed in fluid communication with a drain on a submerged surface of the swimming pool, and the third opening 22 is placed in fluid communication with the water surface of the swimming pool. During operation, fluid circulation provided by the pump causes water to flow inward from both the second and third openings, thereby providing fluid flow through the drain in the swimming pool. The container 32 may further be positioned within the housing 10 to catch debris or other objects drawn into the housing 10, such that the debris is contained within the debris-retaining region 38 of the container and thereby preventing obstruction or clogging of the openings of the housing 10 and subsequent interference with fluid circulation in the swimming pool. Further, the member 42 of the container 32 may be situated such that the member opening 46 is positioned above the water surface 48 and in fluid communication with the surrounding atmosphere. Where the housing 10 is covered by the lid 28, the fluid communication between the member opening 46 of the elongate member 42 of the container 32 and the atmosphere may be maintained by positioning the opening 30 of the lid 28 adjacent to the opening in the member 42.

In the event the drain of the swimming pool becomes obstructed by a person in the swimming pool, the resulting blockage and entrapment of the person prevents fluid from being drawn into the housing 10 through the second opening 20. Despite the blockage, the pump continues to draw water through the first opening 18, resulting in a suction force experienced at the second opening 20, and thus causing an entrapment force at the swimming pool drain. However, as previously discussed, the actual entrapment force experienced at the drain can be reduced and/or limited by predetermined dimensions of the housing 10, including the vertical height "V" separating the second opening 20 from the water surface 48. As such, by selecting and constructing the housing 10 to contain predetermined dimensions, the entrapment force experienced upon blocking the swimming pool drain and thus water flow through the second opening 20 of the housing 10, the entrapping force may be limited to a range of approximately 10-25 pounds of force. Accordingly, due to the reduced entrapping force, an individual should be able to pull themselves free of the swimming pool drain and swim to safety.

Nevertheless, the potential remains that an individual may not be able to free themselves from the drain, even with the reduced entrapment force provided by the housing 10. As previously discussed, despite the blockage of fluid intake through the second opening 20 of the housing 10, the pump will continue to draw fluid through the first opening 18. By continuing to draw fluid through the first opening 18, the water volume in the housing 10 may begin to decrease, causing the water level within the housing 10 to be lowered towards the first opening 18. Once the water level within the housing 10 is drawn below a top edge of the second opening 20, the entrapping force caused by the suction of the pump will be eliminated, as air will enter the second opening 20 to effectively break the sealed vacuum and the resulting force. However, with conventional skimmer baskets, the debris-retaining region of the basket may be filled with leaves or other pool debris. Although the basket itself may contain multiple openings to allow fluid flow therethrough, the leaves and/or additional debris may effectively block the openings. As a result, a filled conventional basket could seal an upper portion of the housing 10, which would prevent the pump from pulling the water level down and/or substantially eliminate the chance that air may enter the housing 10 and further into the second opening 20 to break the entrapment force at the drain. Thus, a filled conventional skimmer basket could present a substantially impermeable layer that obstructs any fluid from passing through, which would cause substantially the full force of the pump to pull directly on the second opening 20, and thus the drain.

By positioning the container 32 of the present invention within the housing 10, the member 42 of the container 32 may provide a fluid flow path from the first opening 18, through the container opening 44 and out of member opening 46 to the surrounding atmosphere, where the fluid flow path is thus separated from the debris-retaining region 38 of the container 32. As such, regardless of the contents of the container 32, fluid communication between the first opening 18 (and thus the pump), the water volume within the housing 10, and ultimately the surrounding atmosphere, is ensured. Consequently, upon a blockage of the drain of the pool and thus the second opening 20 of the housing 10, the water level of the housing 10 may be reduced to allow air to enter the second opening 20 and to break the vacuum seal, thereby allowing an entrapped individual to swim to safety.

Figure 4:
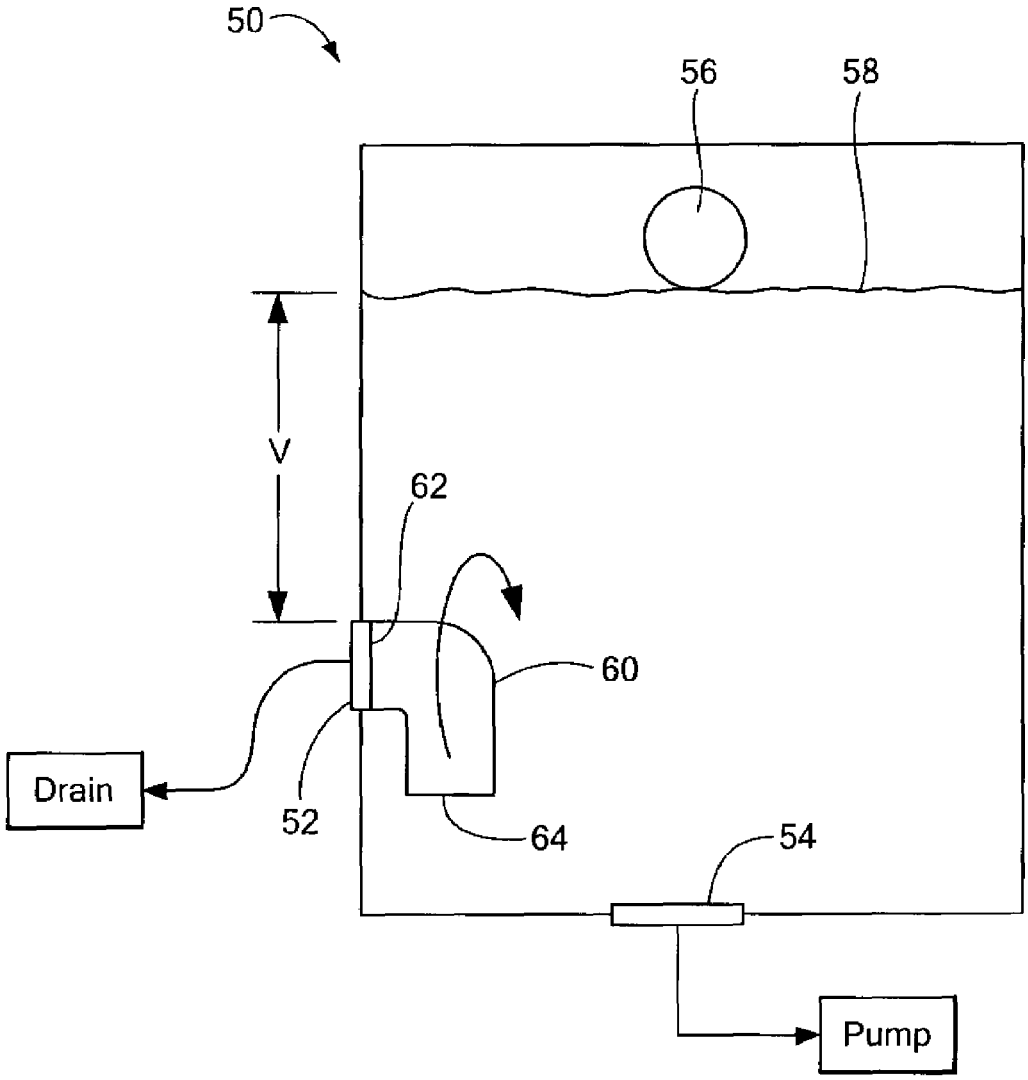
FIG. 4 is a cross-sectional view of an embodiment of a collector vessel in accordance with the present invention.

Now referring to FIG. 4, the present invention may further include a collector vessel 50 or container coupled to a swimming pool, where the collector vessel 50 is dimensioned and configured to reduce the entrapment force experienced at a drain on a submerged surface of a swimming pool in addition to and/or alternatively to the skimmer housing 10 described above. For example, the collector vessel 50 may include a housing coupled to a swimming pool, where the vessel 50 housing includes one or more openings in fluid communication with one or more drains located throughout the pool, as well as one or more openings in fluid communication with one or more pumps providing water circulation throughout the pool. In particular, the collector vessel 50 may include a first opening 52 in fluid communication with a drain, a second opening 54 in fluid communication with a pump, and a third opening 56 to allow excess fluid to overflow out of the vessel 50, which may be either in a sidewall of the vessel or a top opening providing access to the interior of the vessel. Similarly to the skimmer housing 10 discussed above, should a drain in the pool become obstructed, the resulting entrapping force may be directly correlated to the dimensions and resulting water volume of the collector vessel 50. The vessel 50 may thus be configured and dimensioned such that in the event of an entrapment, the maximum force experienced at the pool drain is limited to enable a person or child to be able to free themselves without additional aid, i.e., in the range of about 10-25 pounds.

As an example of a particular configuration, the first opening 52 of the vessel 50 may be located at a vertical distance from the water surface level 58 within the vessel 50. This water surface level may be at the top of the housing, just below the third opening 56, or simply at a height between the second opening 54 and a top edge of the vessel 50. Regardless of how the water surface level is achieved and/or attained in the vessel 50, a vertical distance "V" between the water surface level 58 and an upper edge of the first opening 52 may define a height of a column of water within the vessel 50. As discussed above, a vertical column of water of approximately 11 inches between the first opening 52 and the water surface in the vessel 50 results in approximately 15.87 pounds of force experienced at the drain during entrapment.

While collector vessels, auxiliary housings, and sumps may be typically installed in a swimming pool system to regulate flow rates of circulation, aid in filtration, etc., due to widely varying pool designs and construction techniques, it would be very difficult to install a collector vessel 50 such that the first opening 52 is between approximately 5 inches and 20 inches from the ultimate water surface level in the vessel 50. For example, when constructing a pool, upon placement of the desired plumbing conduits and such, the pool is sprayed with concrete, and furthermore, tiling and other surface layers may also be added. As the construction proceeds to completion, the plumbing may be offset from the originally desired position, assuming the initial placement was even accurate. As such, there may be a plumbing conduit leading from a drain in the pool through a concrete sidewall for connection to a collector vessel 50. The vessel 50 then needs to be positioned to connect to the fixed location of the plumbing conduit while being aligned with or proximate to a top edge of the pool. As such, variations in the location of the conduit require modifications to the vessel 50, which would necessarily affect the resulting column of water height above the first opening 52 of the housing once installed.

Given the calculation above, it can be seen that variations of even a few inches in the height of the column of water in the vessel 50 or skimmer housing can drastically affect the ultimate entrapment force experienced at the drain when the pool is in use. Accordingly, the collector vessel 50 may include a port or opening coupled to the drain, where the height or vertical positioning of the port or opening is selectively adjustable and/or the effective height of a water column above the port or opening is selectively adjustable. For example, the collector vessel may include an extension element 60 in fluid communication with/or otherwise coupled to the first opening 52. The extension element 60 may be movably positionable about the first opening 52 to adjust the effective column of water height above the first opening 52 and to further ensure that the entrapment force at the drain is minimized to a desirable degree. In particular, the extension element 60 may include a body having a first extension opening 62, a second extension opening 64, and a passage therebetween. The first extension opening 62 may be coupled to the first opening 52 of the vessel 50. The extension element 60 may then be manipulated such that the second extension opening 64 is offset from the first extension opening 62 to provide a height from the water surface level of approximately 8 to 14 inches. As a result, even if the first opening 52 of the collector vessel 50 is at an undesirable height or location from the top of the vessel 50 or where the water surface will be, the extension element 60 allows the effective height of the water above the first opening 52 to be adjusted by adjusting the elevation of the second extension opening 64 to provide the desired water column height, and thus the entrapment force experienced at the drain. While an extension element has been described to facilitate the height of a column of water above the opening or port in communication with the drain, it is contemplated that the collector vessel may include an opening on a track or movable surface (not shown) to allow for adjustment, and further, the collector vessel may include a plurality of discrete positions (not shown) about which an opening or port may be selectively located in order to control the resulting hydrostatic pressure within the vessel and towards the drain.

Upon installing the collector vessel and positioning the second extension opening at the desired height or elevation, the collector vessel may function similarly to the skimmer housing described above. During normal operation, water will flow through the collector vessel and other components of a swimming pool's circulation system. Should an entrapment occur at a drain submerged in the swimming pool, the fluid in the collector vessel will be drawn down towards the opening coupled to the pump until air enters the extension element and/or the opening leading to the covered drain. Once air enters the opening or conduit coupled to the drain, the vacuum force experienced will be eliminated to allow an entrapped person to swim to safety. Due to the manipulation of the height of the column of water above the opening leading to the drain, the suction force experienced at the drain is reduced until the vacuum force is subsequently eliminated.

By providing for the adjustment of the effective height of the column of water about the first opening 52 of the vessel 50, inaccuracies or errors occurring during the construction of the pool can be overcome to ensure appropriate operation and limiting of the entrapment force at the drain. As such, the likelihood that the entrapment force will exceed the desired range can be reduced to ensure the safety of swimmers, and vice/versa, sufficient force can be maintained to ensure that fluid flow throughout the circulation system of the swimming pool is also at a desirable rate.

Figure 5:
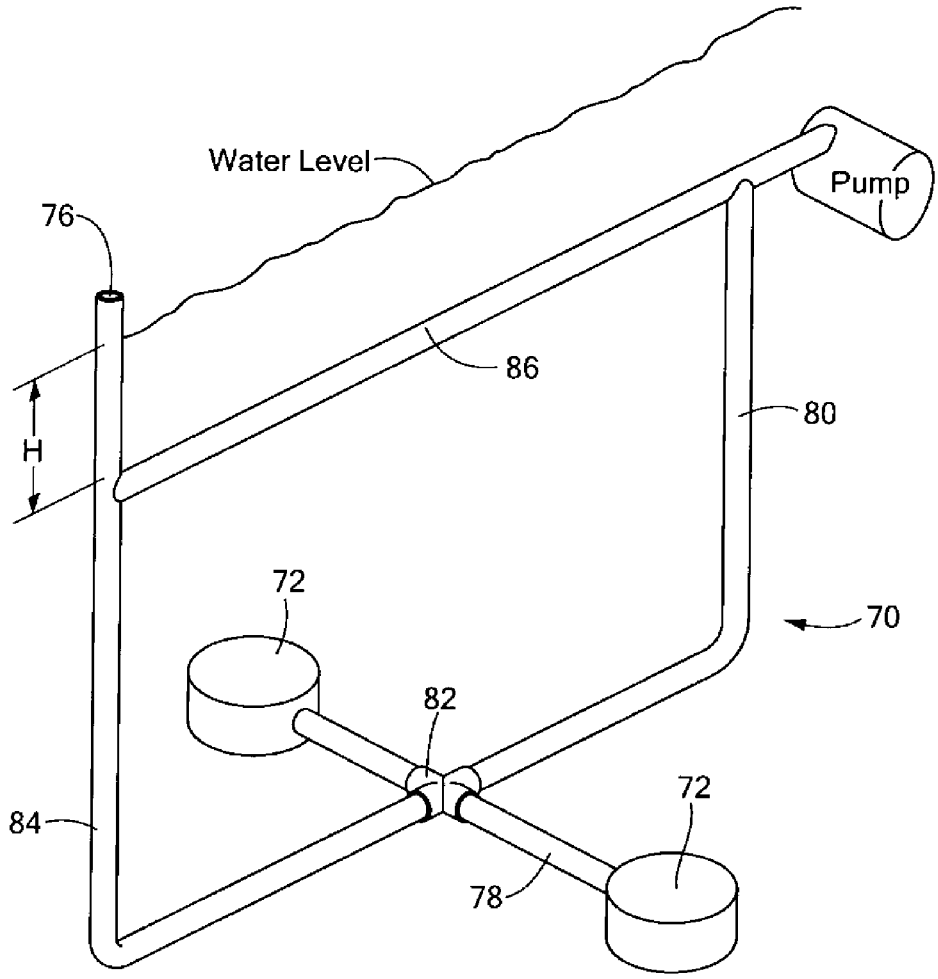
FIG. 5 is an illustration of a pool safety system configuration in accordance with the present invention.
Figure 6:
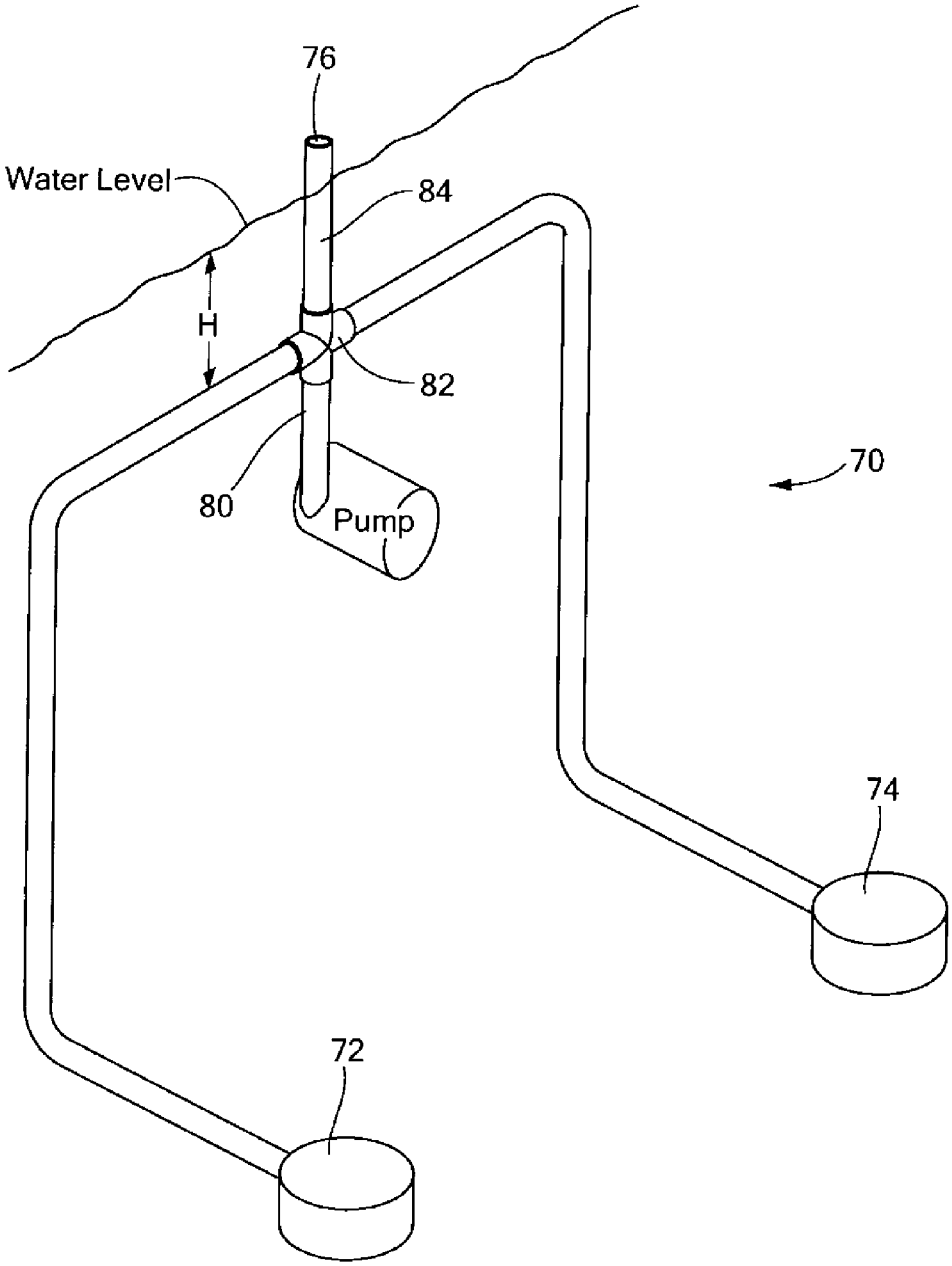
FIG. 6 is an additional schematic of a pool safety system configuration in accordance with the present invention.

Now referring to FIGS. 5 and 6, embodiments of a pool system 70 are shown. The pool system configuration may generally include two or more drains located on a submerged surface of a swimming pool, where the drains are coupled to a pump and a vent. The placement of the drains and the conduits leading to the pump and the vent may be configured to allow for a higher flow rate of fluid through the system while maintaining a reduced operating drawdown. In particular, the pool system 70 may include a first drain opening 72 and a second drain opening 74 located within a swimming pool. Both the first and second drain openings may be in fluid communication with a pump, as well as being in fluid communication with a vent or opening 76 in fluid communication with the surrounding atmosphere. The first and second drain openings may be coupled through a drain line or conduit 78. Of note, as used herein, the term "conduit" is intended to encompass a body or element providing for the passage or flow of fluid. A conduit in a particular application may either be continuous or include multiple discrete sections coupled together. In addition, the pump may be coupled to the first and second drain openings through a first pump line 80 or conduit that intersects and/or forms a junction 82 with the drain line 78. Similarly, the vent 76 may be coupled to the first and second drain openings through a vent line 84 that also intersects and/or forms a junction with the drain line 78, where the location of the intersection between the drain line 78 and the vent line 84 is at substantially the same location as the intersection of the first pump line 80 and the drain line 78. The vent line 84 may further be coupled to the pump through a second pump line 86, where the vent line 84 defines a water height "H" above the second pump line 86 when the system is in use, as shown in FIG. 5. Alternatively, the vent line 84 may include a water height "H" within the conduit above the junction as shown in FIG. 6. The height of the water column present in the vent line 84 that is above the second drain line 86 or the junction 82 defines the drawdown amount required to break a vacuum force and the resulting pressure experienced at the pool drain openings during an entrapment. It is desirable to limit the amount of water drawn down through the vent line for a given rate of flow through the system in order to reduce the likelihood of damage to the system and to control the overall hydraulic conditions of the system.

During general operation of the pool system, water is drawn in through both the first and second drain openings, while the vent line 84 remains exposed to the surrounding atmosphere with a particular water column height above the second pump line 86. In the event of an entrapment, the pump will drawdown the water in the vent line 84 located above the second pump line 86 or the junction 84, subsequently allowing air to enter into the second pump line 86 or the first pump line 80 and thereby breaking the vacuum force at either drain opening. However, as water flows in both drain openings and towards the junction 82 with the first pump line 80, the fluid flow from each drain opening essentially collides at the junction 82 as it is drawn towards the pump. This collision causes an increase in static pressure, which results in a higher water level in the vent line 84 as opposed to what the water height would be if the vent line 84 intersected the drain line 78 elsewhere. Accordingly, coupling the vent line 84 at the junction 82 takes advantage of the increased static pressure, which enables the system to operate at a lower draw down for a given flow rate. For example, at flow rate "A," the pump may typically draw down seven inches of water from the vent line. However, by placing the vent line at the junction with the pump line, the operating draw down may be reduced to five inches for the same flow rate. As a result, the circulation rate through the pool system 70 may be increased while keeping the water level in the vent line 84 at a higher level, which reduces the likelihood that the pump will cavitate and/or be damaged. In particular, the water column height above the second pump line may be limited between 5 and 20 inches while achieving higher flow rates through the system than would otherwise be possible.

Figure 7:
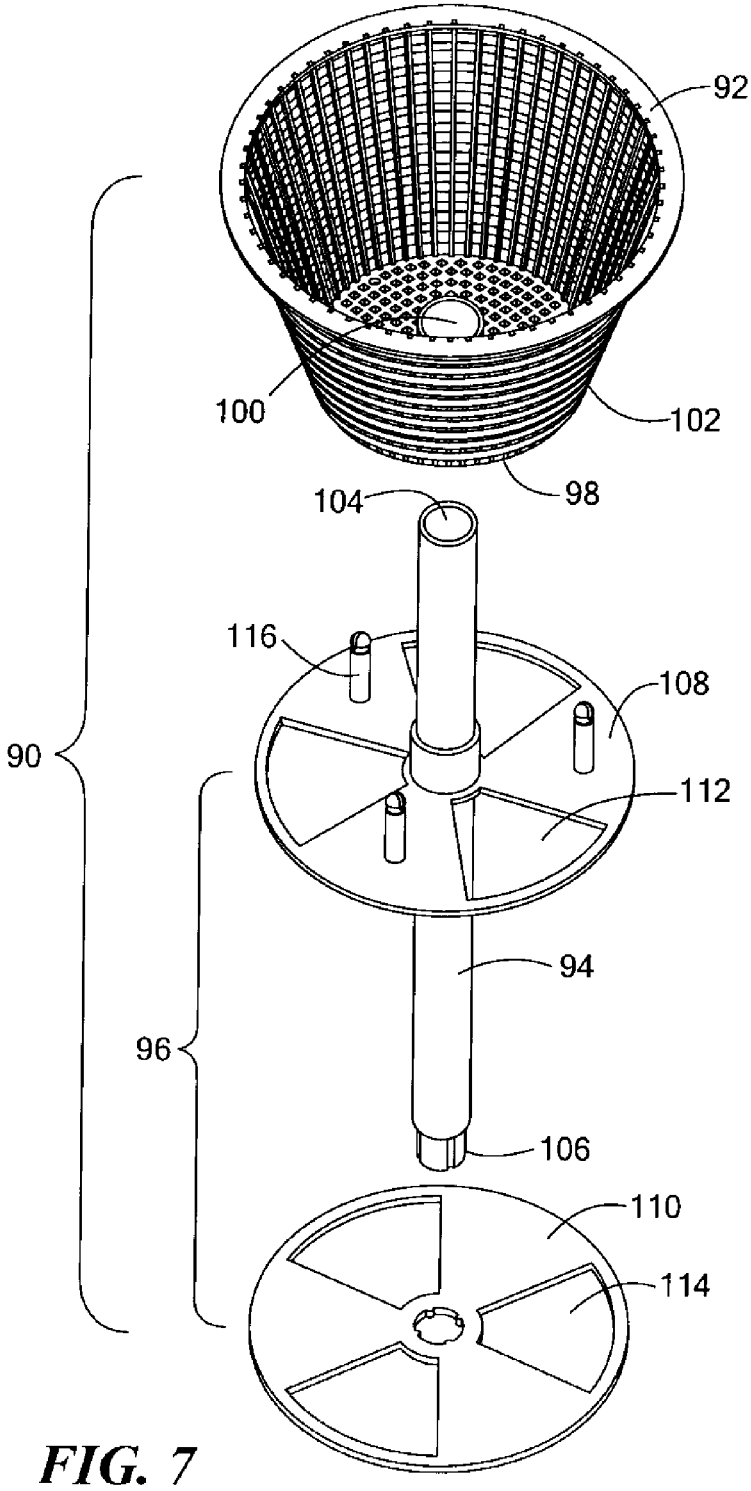
FIG. 7 is an assembly view of an embodiment of a skimmer assembly in accordance with the present invention.
Figure 8:
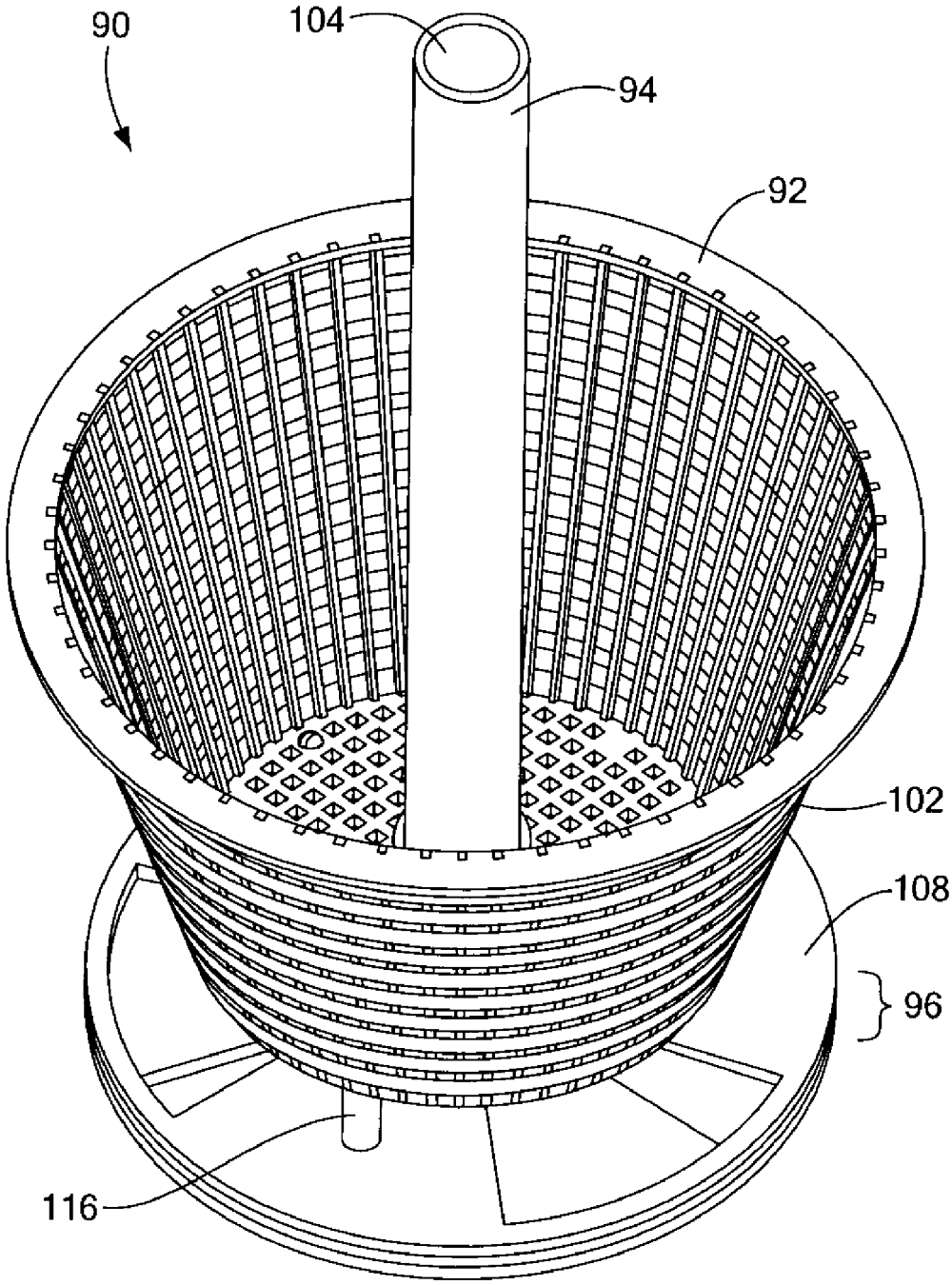
FIG. 8 shows an embodiment of a skimmer assembly in accordance with the present invention.

Now referring to FIGS. 7 and 8, an embodiment of a skimmer assembly 90 is shown. The skimmer assembly 90 may generally include a container 92, such as a skimmer basket or the like, as well as a member 94 and a valve 96. As used herein, the term "valve" is referred to as any device for halting, modifying and/or or controlling the flow of a fluid or material through a passage. In particular, the container 92 of the skimmer assembly 90 may define a container bottom wall 98 with an opening 100 therethrough, and one or more container sidewalls 102 extending upward around a periphery of the bottom wall 98, where the one or more sidewalls define a rim or top edge of the container 92 when oriented in a position for use. The container bottom wall and the container sidewalls define a debris-retaining region for collecting items floating in the pool as they are drawn into the container 92 by the circulation of pool water. One or more apertures may be situated about the container bottom wall 98 and/or the one or more container sidewalls for allowing the passage of water therethrough while retaining larger objects and debris contained within the debris-retaining region for subsequent cleaning or removal. The container 92 may include a myriad of shapes and dimensions which can be varied for a particular use and/or application. The member 94 of the skimmer assembly 90 may define a first opening 104 at a first end, a second opening 106 at a second end, and a passage therethrough placing the first and second openings in fluid communication with one another. The member 94 may be movably positionable through the opening 100 in the bottom wall 98 of the container 92.

The valve 96 of the skimmer assembly 90 may be included to modify and/or control the fluid flow rate of water through the skimmer housing. The valve 96 may be coupled to either of and/or both the container 92 and the member 94. For example, the valve 96 may include a first component 108 and a second component 110, where the first and second components may be movable with respect to each other in order to affect a particular fluid flow rate through the valve 96. In particular, the valve 96 may include a first component 108 defining at least one opening 112 therethrough, as well as a second component 110 having a second opening 114 therethrough. At least one of the first and second components may be movable relative to one another in order to modify the overlap or amount of fluid communication between the first and second openings of the components, thus modifying or controlling the amount of fluid that passes through the first and second openings of the valve 96. In the embodiment shown in FIGS. 7 and 8, the first and second components are disc-shaped, and they may have dimensions complementary or similar to that of the bottom wall 98 of the container 92. For example, the first and second components may define a diameter, where the diameter of the first and/or second component is approximately equal to a diameter of a portion of the container 92, such as the bottom wall 98. Each of the first and second components of the valve 96 may include a central aperture such that the first and second components of the valve 96 may slidably couple to the member 94. The first component 108 may also be engageable with a portion of the container 92. For example, the first component 108 of the valve 96 may include one or more protruding elements 116 that couple to the bottom wall 98 and/or an additional portion of the container 92.

In an exemplary operation of the skimmer assembly 90 described above, the container 92, member 94, and the valve 96 may be placed inside a housing coupled to a pool. The housing may be similar to that shown in FIGS. 1 and 3, where the housing includes openings coupled to a pump, a drain, and the upper water surface of the swimming pool. The container 92 may be positioned within the housing such that it rests on a ledge or rim typically included in such housings for retaining a skimmer basket. The member 94 may then be positioned such that is extends through the opening in the bottom wall 98 of the container 92. Further, the member 94 may be positioned such that the first opening 104 at the first end is located above the rim of the container 92, while the second opening 106 extends below the opening in the bottom wall 98 of the container 92. At least a portion of the valve 96 may then be coupled to the member 94, and in particular, the first and second components of the valve 96 may be slidably positioned along a length of the member 94 extending below the container 92. In a particular embodiment, the first component 108 of the valve 96 may further be coupled to the container 92, while at the same time remaining movably and/or rotatably coupled to the member 94. Furthermore, the second component 110 of the valve 96 may be somewhat affixed to the member 94 in a desired position. As such, when the skimmer assembly 90 is appropriately positioned, the portion of the member 94 that extends upward from the container 92 may be rotated. Upon rotating the member 94, the container 92 and/or the first component 108 of the valve 96 may remain in place, as they are only loosely and/or movably coupled to the member 94. However, should the second component 110 of the valve 96 be substantially affixed to the member 94, then the second component 110 may rotate as the member 94 is turned. Upon rotating the member 94, and thus the second component 110, the overlap and/or level of fluid communication between the one or more openings in the first component 108 and the one or more openings of the second component 110 may be adjusted and/or modified, thereby modifying and/or adjust the amount of fluid able to flow through the respective openings. In addition, should the member 94 extend above the container 92 and/or the water level, the member 94 can thus provide for simplified removal of the entire assembly 90, i.e., by pulling the member 94 out of the skimmer housing, the valve 96 will come into contact with a bottom portion of the container 92 (if they are not previously coupled), and as such, the entire assembly 90 may be removed from the skimmer housing as a unit, even though the member 94 may not necessarily be coupled to the container 92 prior to removal.

As such, during operation, fluid circulation through the skimmer housing causes water to flow inward. The container 92 may then catch debris or other objects drawn into the housing, such that the debris is contained within the debris-retaining region of the container 92 and thereby preventing obstruction or clogging of the openings of the housing and subsequent interference with fluid circulation in the swimming pool. In addition, the member 94 may be situated such that the first opening 104 is positioned above the water surface and in fluid communication with the surrounding atmosphere. As discussed above, the member 94 may provide a fluid flow path through the container 92 and out of the member 94 to the surrounding atmosphere, where the fluid flow path is thus separated from the debris-retaining region of the container 92. As such, regardless of the contents of the container 92, fluid communication between the first opening 18 of the housing (and thus the pump), the water volume within the housing 10, and ultimately the surrounding atmosphere, is ensured. Moreover, the modification of the fluid flow through the skimmer housing via manipulation of the member 94 and/or valve 96 in the skimmer assembly 90 does not interfere with or otherwise obstruct the fluid flow path provided by the member 94 from the pump to the surrounding atmosphere. Consequently, upon a blockage of the drain of the pool, the water level of the housing 10 may be reduced to allow air to enter the second opening 20 of the housing and to break the vacuum seal, thereby allowing an entrapped individual to swim to safety.

Figure 9:
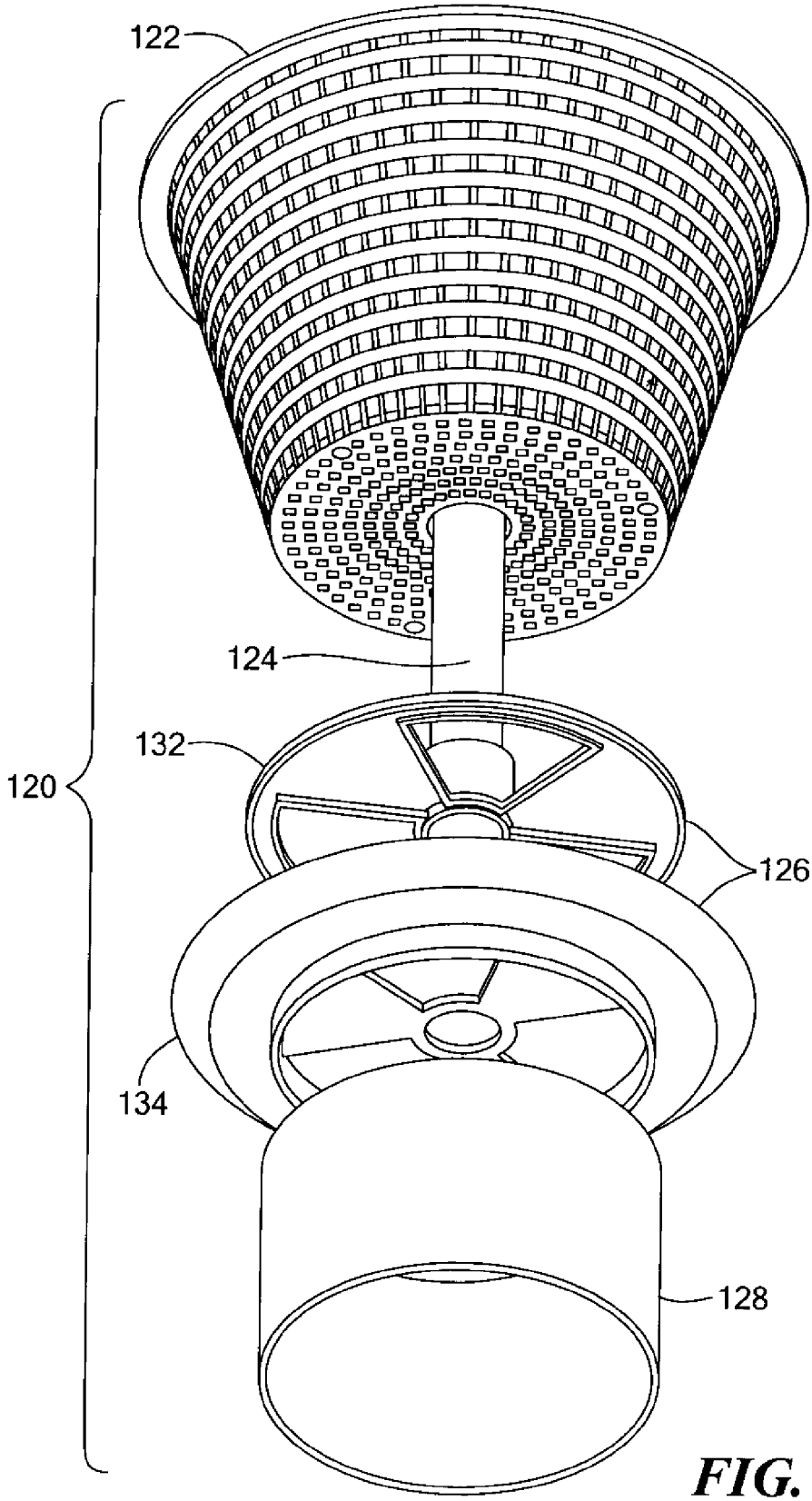
FIG. 9 is an illustration of an embodiment of a skimmer assembly in accordance with the present invention.
Figure 10:
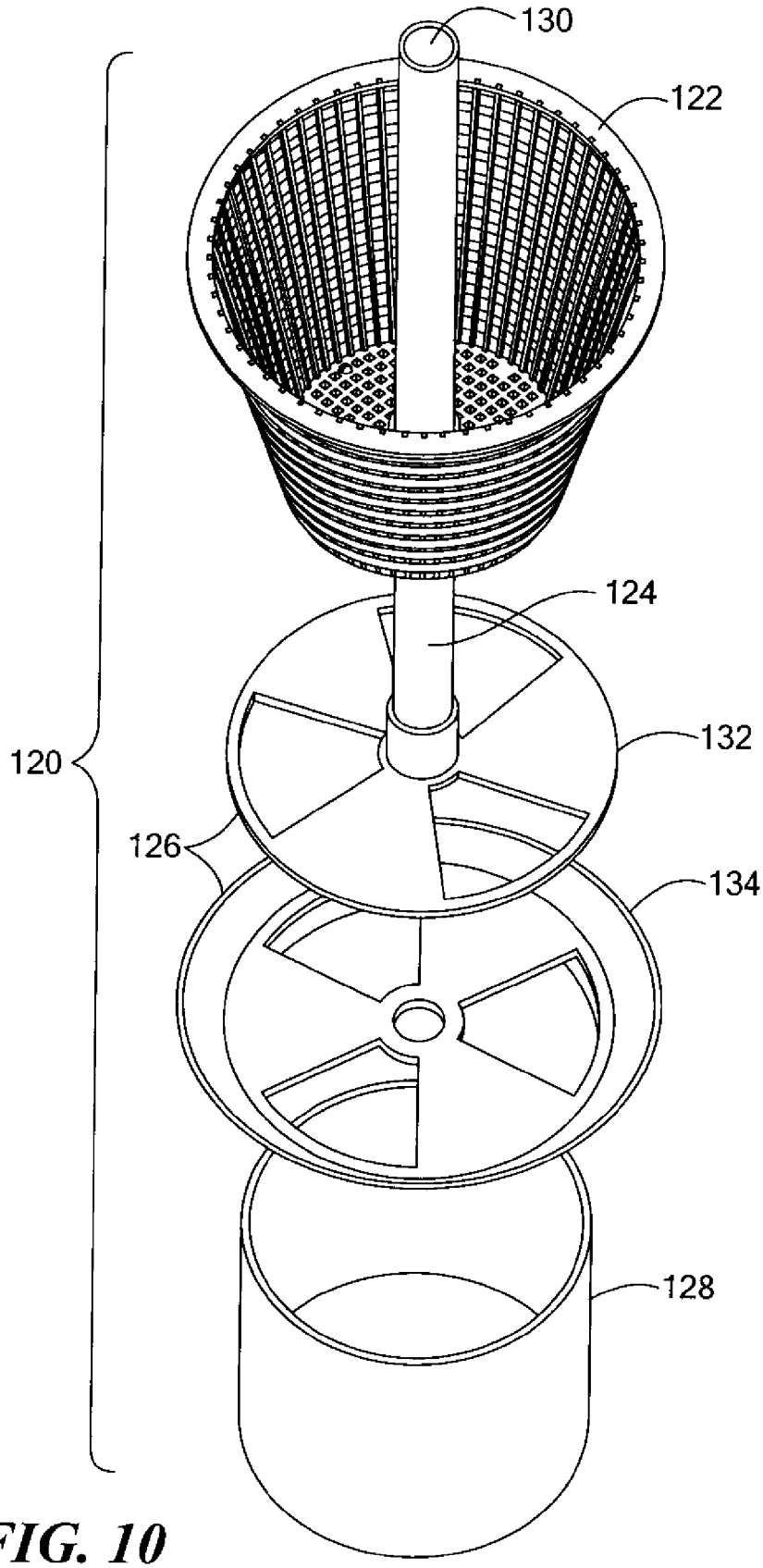
FIG. 10 is an additional drawing of an embodiment of a skimmer assembly in accordance with the present invention.

Now referring to FIGS. 9 and 10, an additional embodiment of a skimmer assembly 120 is shown, where the skimmer assembly 120 may generally include a container 122, a member 124, a valve 126, and a base element 128. Similar to the container 122 described above, the container 122 of the skimmer assembly 120 may define a container bottom wall with an opening therethrough, and one or more container sidewalls extending upward around a periphery of the bottom wall, where the one or more sidewalls define a rim or top edge of the container 122 when oriented in a position for use. The container bottom wall and the container sidewalls define a debris-retaining region, and one or more apertures may be situated about the container bottom wall and/or the one or more container sidewalls for allowing the passage of water therethrough. The member 124 of the skimmer assembly 120 may define a first opening 130 at a first end, a second opening at a second end, and a passage therethrough placing the first and second openings in fluid communication with one another. The member 124 may be movably positionable through the opening in the bottom wall of the container 122.

In addition, at least a portion of the valve 126 may be coupled to the member 124. For example, the valve 126 may include a first component 132 and a second component 134, where the first and second component 134*s* may be movable with respect to each other in order to affect a particular fluid flow rate through the valve 126. In particular, the valve 126 may include a first component 132 defining at least one opening therethrough, as well as a second component 134 having a second opening therethrough. The first and second components may be moved relative to one another in order to modify the overlap or amount of fluid communication between the first and second holes of the components, thus modifying or controlling the amount of fluid that passes through the first and second openings of the valve 126. Each of the first and second components of the valve 126 may include a central aperture such that either and/or both of the first and second components of the valve 126 may movably and/or fixedly couple to the member 124.

The skimmer assembly 120 may further include the base element 128. The base element 128 may provide for a desired clearance and/or positioning of the components of the skimmer assembly 120 with respect to the skimmer housing and/or the components themselves. For example, the base element 128 may define a cylindrical body, where the cylindrical body may be substantially hollow. Of course, the sizes and shapes of a particular base element 128 for a specific application may be modified as needed. The base element 128 may be positionable about a portion of the skimmer housing, for example, the base element 128 may rest on a bottom surface of the skimmer housing. The valve 126 of the skimmer assembly 120 may then be poisoned such that at least a portion of the valve 126 is either coupled to and/or in contact with the base element 128. For example, the second component 134 of the valve 126 may be positioned to rest on an upper edge of the base element 128. The second component 134 may define a lip or raised portion on a surface to aid in positioning and/or coupling the component and the base element 128. In addition, the first component 132 of the valve 126 may be movably positioned and/or coupled to the second component 134 of the valve 126, where the first component 132 may also be either movably or fixedly coupled to the member 124.

In an exemplary operation of the skimmer assembly 120, the container 122, member 124, valve 126, and base element 128 may be placed inside a housing similar to that shown in FIGS. 1 and 3, described above. The base element 128 may be positioned on a bottom surface of the housing, and at least a portion of the valve 126 may be positioned and/or coupled to the base element 128. For example, the second component 134 may rest on an upper edge or surface of the base element 128. In addition, the first component 132 of the valve 126 may be coupled or otherwise positioned in proximity to the second component 134, where at least one of the first and second components is movable with respect to one another. The first component 132 may further be coupled to the member 124, where the member 124 extends upward in the housing towards, and possibly beyond, the water surface. The container 122 may be positioned within the housing such that it rests on a ledge or rim of the housing such that the member 124 passes through the opening in the bottom wall of the container 122. Further, the member 124 may be positioned such that the first opening 130 at the first end is located above the rim of the container 122, while the second opening extends below the opening in the bottom wall of the container 122. As the container 122 may rest on a ledge or rim in the housing, and as the member 124 is supported by, coupled to and/or positioned relative to the valve 126 and/or base member 124, the basket may be removed from the housing while the remaining portions of the skimmer assembly 120 remain in the housing.

When the skimmer assembly 120 is appropriately positioned, the portion of the member 124 that extends upward from the container 122 may be rotated. As the first component 132 of the valve 126 may be fixedly attached to the member 124, rotation of the member 124 may thus cause rotation of the first component 132. However, the second component 134 of the valve 126 may remain in place, as it may only be loosely and/or movably coupled to the member 124 and/or the first component 132. As such, through manipulation of the member 124, and thus the first component 132, the overlap and/or level of fluid communication between the one or more openings in the first component 132 and the one or more openings of the second component 134 may be adjusted and/or modified, thereby modifying and/or adjusting the amount of fluid able to flow through the respective openings. In addition, should the member 124 extend above the container 122 and/or the water level, the member 124 can thus provide for simplified removal of the entire assembly 120 as described above.

As such, during operation, fluid circulation through the skimmer housing causes water to flow inward. The container 122 may then catch debris or other objects drawn into the housing, such that the debris is contained within the debris-retaining region of the container 122 and thereby preventing obstruction or clogging of the openings of the housing and subsequent interference with fluid circulation in the swimming pool. In addition, the member 124 may provide a fluid flow path through the container 122 and out of the member 124 to the surrounding atmosphere, where the fluid flow path is thus separated from the debris-retaining region of the container 122. As such, regardless of the contents of the container 122, fluid communication between the first opening 18 of the housing (and thus the pump), the water volume within the housing 10, and ultimately the surrounding atmosphere, is ensured. Moreover, the modification of the fluid flow through the skimmer housing via manipulation of the member 124 and/or valve 126 in the skimmer assembly 120 does not interfere with or otherwise obstruct the fluid flow path provided by the member 124 from the pump to the surrounding atmosphere. In addition, the container 122 may be freely removed from the housing while the member 124 and additional parts of the assembly 120 remain in place, ensuring that the safety of the unobstructed fluid flow path remains in place. For example, the container 122 may be removed for cleaning, or for connecting a hose or the like to one of the openings in the housing, etc., without the need to remove the entire assembly 120. Consequently, upon a blockage of the drain of the pool, the water level of the housing 10 may be reduced to allow air to enter the second opening 20 of the housing and to break the vacuum seal, thereby allowing an entrapped individual to swim to safety, irrespective of the positioning of the container.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A swimming pool device, comprising:

a container defining a rim and a first opening below the rim;

a member movably positionable through the first opening of the container, the member defining a second opening, a third opening, and a passage therethrough providing fluid communication between the second opening and the third opening; and a valve coupled to at least one of the container and the member; the valve including first and second components coupled to the member; wherein the first component is coupled to the container.

2. The swimming pool device according to claim 1, wherein the second opening of the member is located above the rim of the container, and wherein the third opening of the member is located below the container.

3. The swimming pool device according to claim 1, wherein at least a portion of the valve circumscribes the member such that the valve does not obstruct the passage of the member.

4. The swimming pool device according to claim 1, wherein each of the first and second components defines at least one opening.

5. The swimming pool device according to claim 1, wherein the first and second components are substantially disc-shaped.

6. The swimming pool device according to claim 1, wherein the container further defines a plurality of apertures for fluid flow therethrough.

7. The swimming pool device according to claim 1, further comprising a base element in contact with at least one of the valve and the member.

8. The swimming pool device according to claim 1, wherein the member is movably positionable with respect to the container.

9. The swimming pool device according to claim 1, wherein at least one of the first and second components is movable with respect to the other.

10. The swimming pool device according to claim 9, wherein each of the first and second components defines at least one opening.

11. The swimming pool device according to claim 9, wherein the first component is movably coupled to the member, and wherein the second component is fixedly coupled to the member.

12. The swimming pool device according to claim 9, wherein the first and second components are substantially disc-shaped.

13. A swimming pool device, comprising:

a container defining a rim, a bottom wall having a diameter, and a first opening below the rim;

a member movably positionable through the first opening of the container, the member defining a second opening, a third opening and a passage therethrough providing fluid communication between the second opening and the third opening; and a valve coupled to at least one of the container and the member; the valve including first and second substantially disc-shaped components coupled to the member; the first and second components having a diameter substantially equal to the diameter of the bottom wall of the container.

14. The swimming pool device according to claim 13, wherein at least a portion of the valve circumscribes the member such that the valve does not obstruct the passage of the member.

15. A swimming pool device, comprising:

a container defining a rim, a bottom wall having a diameter; and a first opening below the rim;

a member extending from the first opening, the member defining a second opening located above the rim and a passage therethrough providing fluid communication between the first opening and the second opening; and a valve coupled to at least one of the member and the container; the valve including first and second substantially disc-shaped components, wherein at least one of the first and second components is movable with respect to the other, and wherein the first and second components have a diameter substantially equal to the diameter of the bottom wall of the container.

16. The swimming pool device according to claim 15, further comprising a base element in contact with at least one of the valve and the member.

* * * * *